US005834703A

United States Patent [19]

Fujii et al.

[11] Patent Number: 5,834,703

[45] Date of Patent: Nov. 10, 1998

[54] METHOD OF SECURING CORONA RING

[75] Inventors: Shuji Fujii, Nagoya; Masamichi Ishihara, Ama-Gun, both of Japan

[73] Assignee: NGK Insulators, Ltd., Japan

[21] Appl. No.: 798,159

[22] Filed: Feb. 10, 1997

[30] Foreign Application Priority Data

Feb. 21, 1996 [JP] Japan ..... 8-033483

[51] Int. Cl.[6] ..... H01B 17/00

[52] U.S. Cl. ..... 174/140 CR

[58] Field of Search ..... 74/140 CR, 140 S, 74/140 H, 140 R, 144; 24/483

[56] References Cited

U.S. PATENT DOCUMENTS 5,552,566 9/1996 Lin et al. ..... 174/144

FOREIGN PATENT DOCUMENTS 7-272573 10/1995 Japan ..... H01B 17/44

*Primary Examiner*—Bot L. Ledynh
*Assistant Examiner*—Joseph Waks
*Attorney, Agent, or Firm*—Parkhurst & Wendel

[57] ABSTRACT

A method of securing a corona ring for controlling a corona discharge, including inserting a support member of an insulator to be secured, between a first ring securing portion arranged integrally with the corona ring and a second ring securing portion arranged independently with respect to the first ring securing portion, and fixing the first ring securing portion and the second ring securing portion from each other. In this method, since a corona discharge ring improper mounting preventing apparatus is arranged on the first ring securing portion, one of the ring securing portions is preliminarily secured to the support member, a ring securing method at the seal portion of the support member is improved and/or a corona discharge ring improper mounting preventing apparatus is arranged on said support member it is not possible to fix the corona ring to the support member if the corona ring is secured in an incorrect position with respect to the support member. Therefore, it is possible to prevent a corona ring mis-securing operation.

6 Claims, 7 Drawing Sheets

METHOD OF SECURING CORONA RING

BACKGROUND OF THE INVENTION (1) Field of the Invention

The present invention relates to a method of securing a corona ring used for controlling a corona discharge. In this invention, the corona ring is secured to support metal members arranged at both ends of a porcelain insulator or a polymer insulator.

(2) Related Art Statement

Generally, in order to prevent a corona discharge at both end portions of insulators such as porcelain insulator and polymer insulator, a corona ring is secured to the support metal members arranged at end portions there of. As the corona ring, use is generally made of a circular pipe formed by bending a straight pipe having a circular cross section. Recently, to reduce the weight of the corona ring so as to use the corona ring for polymer insulators, use is sometimes made of the corona ring having a half or a quarter circular cross section.

FIG. 7 is a schematic view with a partial cross section showing a condition that the corona ring is secured to the polymer insulator as a known example. In the embodiment shown in FIG. 7, a polymer insulator 51 comprises an insulation member 52 made of FRP which is arranged at its center portion, an insulation sheath member 53 made of rubber which is molded on an outer surface of the insulation member 52, a plurality of insulation shed members 54 formed on an outer surface of the insulation sheath member 53, and a support metal member 55 arranged at an end portion of the insulation member 52. Moreover, a support bolt 56 is arranged at a tip forked portion of the support metal member 55, and a seal portion 57 having an expanded shape as compared with the other portions is arranged at a base end portion of the support metal member 55.

When the corona ring 58 having a half circular cross section is secured to the support metal member 55 of the polymer insulator 51 as mentioned above, a corona discharging performance of the corona ring 58 is varied in accordance with an opening direction of the corona ring main body 59, i.e. an upper opening or a lower opening. If an opening of the upper corona ring main body 59 is not faced upward and an opening of the lower corona ring main body 59 is not faced downward, discharging performance of the corona ring 58 is decreased.

However, in the known corona ring securing method, the corona ring 58 can be secured to the support metal member 55 regardless of the opening direction. That is to say, both at the upper end and the lower end, the opening of the corona ring 58 can be faced upward and downward. In this case, a worker who secures the corona ring 58 to the support metal member 55 is liable to cause a mis-securing operation, i.e., improper mounting such that an opening of the corona ring main body 59 is faced in a reverse direction as that shown in FIG. 7. If such an operation occurs, excellent corona discharge performance of the corona ring 58 can not be achieved.

Moreover, it is important to set a securing position of the corona ring 58 with respect to the support metal member 55. That is to say, a corona discharge performance of the corona ring 58 is largely varied in accordance with a distance between the corona ring 58 and a first shed portion 54 which is arranged nearest to the corona ring 58. In this respect, a worker is liable to cause a mis-securing operation such that the corona ring 58 is secured to an incorrect position as is the same as the corona ring securing direction mentioned above. In this case, an excellent corona discharge performance can not also be achieved.

SUMMARY OF THE INVENTION

An object of the invention is to eliminate the drawbacks mentioned above and to provide a method of securing a corona ring which can prevent a mis-securing operation of the corona ring.

According to a first aspect of the invention, a method of securing a corona ring for controlling a corona discharge, includes the steps of inserting a support member of an insulator to be secured, between a first ring securing portion arranged integrally with said corona ring and a second ring securing portion arranged independently with respect to said first ring securing portion, fixing said first ring securing portion and said second ring securing portion to each other, a arranging a means for preventing a corona ring mis-securing operation to said first ring securing portion.

Moreover, according to a second aspect of the invention, a method of securing a corona ring for controlling a corona discharge, including the steps of inserting a support member of an insulator to be secured, between a first ring securing portion arranged integrally with said corona ring and a second ring securing portion arranged independently with respect to said first ring securing portion, fixing said first ring securing portion and said second ring securing portion from each other, fixing preliminarily said second ring securing portion to said support member at a predetermined position by means of a fix member, and fixing said first ring securing portion to said preliminarily fixed second securing portion.

Further, according to a third aspect of the invention, a method of securing a corona ring for controlling a corona discharge, includes the steps of inserting a support member of an insulator to be secured, between a first ring securing portion arranged integrally with said corona ring and a second ring securing portion arranged independently with respect to said first ring securing portion, fixing said first ring securing portion and said second ring securing portion from each other, forming a seal portion at an end portion of said support member which has a larger diameter as that of the other portion of said support member, forming a seal portion receiving portion at one end surface of said first ring securing portion and said second ring securing portion which faces to said support member, and fixing said first ring securing portion and said second ring securing portion, such a that (i) said seal portion of said support member is fitted to said seal portion receiving portion arranged to said first ring securing portion and said second ring securing portion, (ii) a part of said first ring securing portion and said second ring securing portion is brought into contact with said support member, and (iii) a length of at least one of said first ring securing portion and said second ring securing portion from said seal portion receiving portion to the other end thereof along a lengthwise direction of said support member is larger than a distance between said seal portion and a shed portion of said insulator.

Moreover, according to a fourth aspect of the invention, a method of securing a corona ring for controlling a corona discharge, includes the steps of inserting a support member of an insulator to be secured, between a first ring securing portion arranged integrally with said corona ring and a second ring securing portion arranged independently with respect to said first ring securing portion, and fixing said first ring securing portion and said second ring securing portion from each other, arranging a means for preventing a corona ring mis-securing operation to said support member, at a position at which said first ring securing portion and said second ring securing portion are not interfered if said corona ring is secured correctly and at a position at which they are interfered if said corona ring is secured incorrectly.

In the present invention mentioned above, since the corona discharge preventing means is arranged to the first ring securing portion in the first aspect, since one of the ring securing portions is preliminarily secured to the support member in the second aspect, since a ring securing method at the seal portion of the support member is improved in the third aspect, and since the corona discharge preventing means is arranged to said support member in the fourth aspect, it is not possible to fix the corona ring to the support member if the corona ring is to be secured in an incorrect position with respect to the support member. Therefore, it is possible to prevent a corona ring mis-securing operation.

BRIEF DESCRIPTION OF THE DRAWINGS

FIGS. 4*a*, 4*b* and 4*c* are schematic views respectively showing one embodiment of a method of securing a corona ring according to a third aspect of the invention;

DESCRIPTION OF THE PREFERRED EMBODIMENTS

Figure 1B:
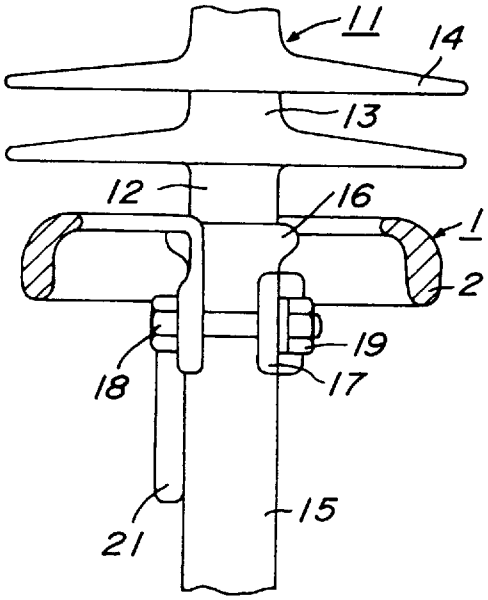
FIGS. 1*a* and 1*b* are schematic views respectively showing one embodiment of a method of securing a corona ring according to a first aspect of the invention.
Figure 1A:
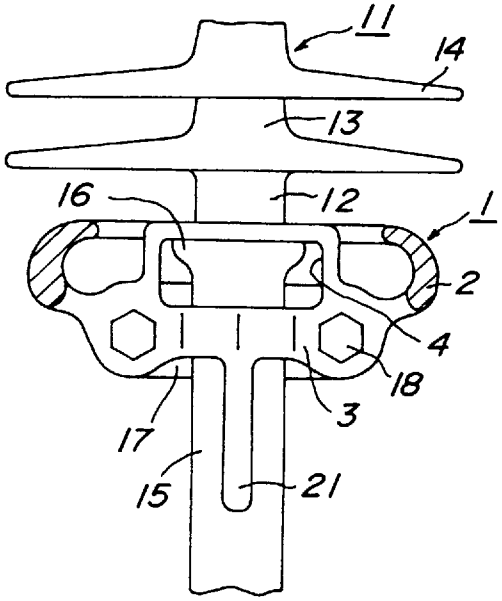

FIGS. 1*a* and 1*b* are schematic views respectively showing one embodiment of a method of securing a corona ring according to a first aspect of the invention. FIG. 1*a* shows a front view thereof and FIG. 1*b* illustrates a side view thereof. In FIGS. 1*a* and 1*b*, a corona ring 1 comprises a corona ring main body 2, and a ring securing portion 3 arranged integrally with the corona ring main body 2 at its inner side. Moreover, a polymer insulator 11 comprises an insulation member 12 made of FRP which is arranged at its center portion, an insulation sheath member 13 made of rubber which is molded on an outer surface of the insulation member 12, a plurality of insulation shed members 14 formed on an outer surface of the insulation sheath member 13, and a support metal member 15 arranged at an end portion of the insulation member 12.

The construction mentioned above is the same as that of the known example. A feature of the invention is to arrange a mis-securing prevention member 21 integrally with the ring securing portion 3 in such a manner that the mis-securing prevention member 21 is extended along an axial direction of the polymer insulator 1. The mis-securing prevention member 21 i.e., means for preventing improper mounting of the corona ring, shown in FIG. 1 has a rod shape, but another shape such as a planar shape may be used freely for this purpose. Moreover, a length of the mis-securing prevention member 21 is set to length such that the corona ring 1 is not secured to the support metal member 15 due to an interference of the insulation shed member 14 which is arranged nearest to the corona ring 1 if the corona ring 1 is to be secured to the support metal member 15 at an incorrect position.

A cross section of the corona ring main body 2 has a half circular shape, but, in the embodiment shown in FIGS. 1*a* and 1*b*, the corona ring main body 2 is partially cut out for a convenience of observing. It should be noted that the shape of the corona ring 1 is not limited, and the present invention can be preferably applied to the corona ring 1 having another shapes.

In the embodiment shown in FIGS. 1*a* and 1*b*, a securing operation of the corona ring 1 to the support metal member 15 is as follows. At first, an expanded seal portion 16 arranged at an end of the support metal member 15 is fitted to an opening portion 4 formed in the ring securing portion (or first ring securing portion) 3, so that the corona ring 1 is positioned with respect to the support metal member 15. After that, a metal fitting member (or second ring securing portion) 17 is set to a portion corresponding to the ring securing portion 3 and arranged rear with respect to the support metal member 15. Then, the ring securing portion 3 and the metal fitting member 17 are fixed with respect to the support metal member 15 by means of bolts 18 and nuts 19. In this manner, the corona ring 1 is fixed to the support metal member 15.

When the corona ring 1 is fixed to the support metal member 15 in the manner mentioned above, the corona ring 1 is not secured to the support metal member 15 if the corona ring 1 is not secured in an incorrect position i.e. the corona ring 1 is to be secured to the insulation 12 other than the support metal member 15. This is because the miss securing prevention member 21 is interfered with the expanded seal portion 16. In the same manner, if the corona ring 1 is to be secured to the support metal member 15 up side down, the mis-securing prevention member 21 is interfered with the insulation shed member 14 or the expanded seal portion 16.

Figure 2B:
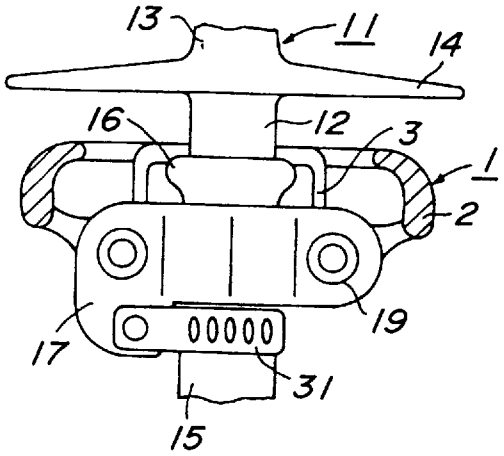
FIGS. 2*a* and 2*b* are schematic views respectively illustrating one embodiment of a method of securing a corona ring according to a second aspect of the invention.
Figure 2A:
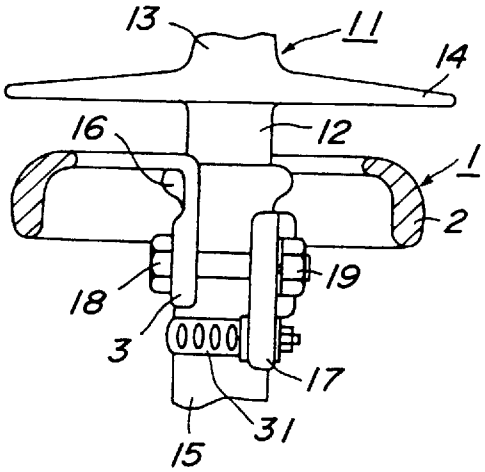

FIGS. 2*a* and 2*b* are schematic views respectively showing one embodiment of a method of securing a corona ring according to a second aspect of the invention. FIG. 2*a* shows a front view and FIG. 2*b* illustrates a side view. In the embodiment shown in FIGS. 2*a* and 2*b*, portions similar to those of FIG. 1 are denoted by the same reference numerals shown in FIG. 1, and the explanations thereof are omitted here. In the embodiment shown in FIGS. 2*a* and 2*b*, a different feature as that of FIG. 1 is that the metal fitting member 17 is preliminarily fixed to the support metal member 15 at a predetermined position by means of a hose band 31 instead of arranging the mis-securing prevention member 21.

In this embodiment, the metal fitting member (or fix member) 17 is preliminarily fixed to the support metal member 15 at a position, at which the opening portion 4 is correctly fitted to the seal portion 16 if the corona ring 1 is to be secured correctly, and at which the corona ring 1 is not secured due to the hose band 31 if the corona ring 1 is to be secured incorrectly i.e. up side down. Therefore, as is the same as the first aspect of the invention, when the corona ring 1 is fixed to the support metal member 15, the corona ring 1 is not secured to the support metal member 15 if the corona ring 1 is to be secured in an incorrect position i.e. the corona ring 1 is to be secured to a position other than the support metal member 15. In the same manner, if the corona ring 1 is to be secured to the support metal member 15 up side down, the ring securing portion 3 of the corona ring 1 is not secured to the metal fitting member 17.

Figure 3B:
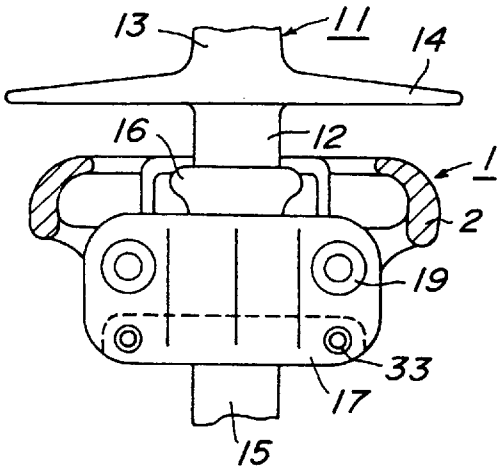
FIGS. 3*a* and 3*b* are schematic views respectively depicting another embodiment of a method of securing a corona ring according to the second aspect of the invention.
Figure 3A:
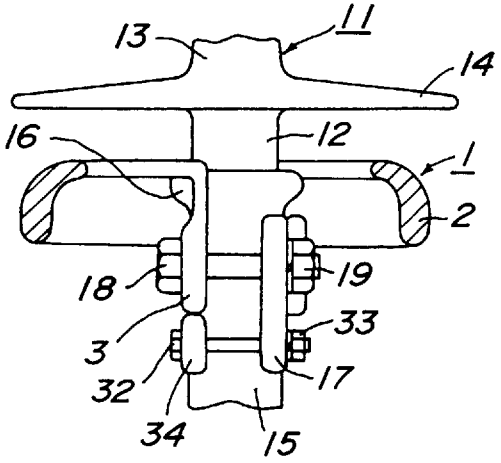

FIGS. 3*a* and 3*b* are schematic views respectively showing another embodiment of the method of the corona ring according to the second aspect of the invention. The embodiment shown in FIGS. 3*a* and 3*b* has substantially the same construction as that of FIG. 2, and thus a detailed explanation is omitted here. A different point is that the metal fitting member 17 is fixed to the support metal member 15 by means of bolts 32, nuts 33 and a fix plate 34 instead of the hose band 31.

Figure 4A:
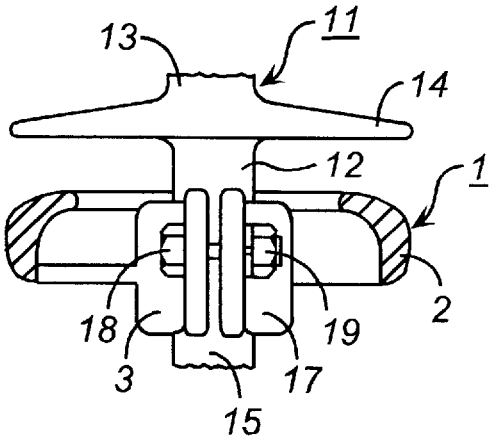
Figure 4B:
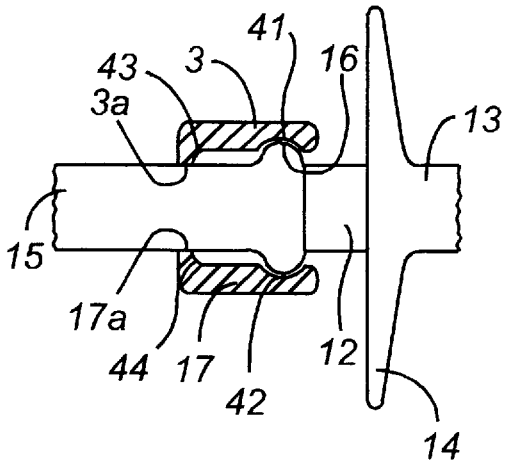

FIGS. 4*a*, 4*b* and 4*c* are schematic views respectively showing one embodiment of a method of securing a corona ring according to a third aspect of the invention. In this embodiment, FIG. 4*a* shows a front view, FIG. 4*b* illustrates a side view with a partial cross section, and FIG. 4*c* depicts a detail securing portion only. In the embodiment shown in FIGS. 4*a*–4*c*, portions similar to those of FIG. 1 are denoted by the same reference numerals shown in FIG. 1, and explanations thereof are omitted here.

In the embodiment shown in FIGS. 4*a*–4*c*, seal portion receiving portions 41 and 42 for receiving the expanded seal portion 16 of the support metal member 15 are formed in the ring securing portion 3 and the metal fitting member 17 respectively at their inner surfaces faced thereto. Moreover, the ring securing portion 3 and the metal fitting member 17 are fixed by means of the bolts 18 and the nuts 19 in such a manner that the expanded seal portion 16 is brought into contact with the seal portion receiving portions 41 and 42 and that an end portion 3*a* of the ring securing portion 3 and an end portion 17*a* of the metal fitting member 17 are brought into contact with the support metal member 15 along an overall surface.

Moreover, since an outer diameter of the support metal member 15 is different from that of the seal portion 16, inner surfaces of the ring securing portion 3 and the metal fitting member 17 are worked to form a space 43 between the ring securing portion 3 and the support metal member 15 and a space 44 between the metal fitting member 17 and the support metal member 15. Further, a length along an axial direction of the support metal member 15 of one of the ring securing portion 3 or the metal fitting 17 is made larger than a distance between the seal portion 16 and the insulation shed portion 14 of the polymer insulator 1 arranged nearest to the corona ring 1.

Therefore, as is the same as the embodiments of the first aspect and the second aspect of the invention mentioned above, when the corona ring 1 is fixed to the support metal member 15, the corona ring 1 is not secured to the support metal member 15 if the corona ring 1 is to be secured in an incorrect position i.e. the corona ring 1 is to be secured under the condition that the seal portion 16 is not fitted to the seal portion receiving portions 41 and 42. In the same manner, if the seal portion 16 is fitted to the seal portion receiving portion 41 and 42 under the condition that the corona ring 1 is to be secured up side down, the corona ring 1 is not secured to the support metal member 15 due to an interference with the insulation shed member 14, since the ring securing portion 3 and the metal fitting member 17 have a predetermined length.

Figure 5:
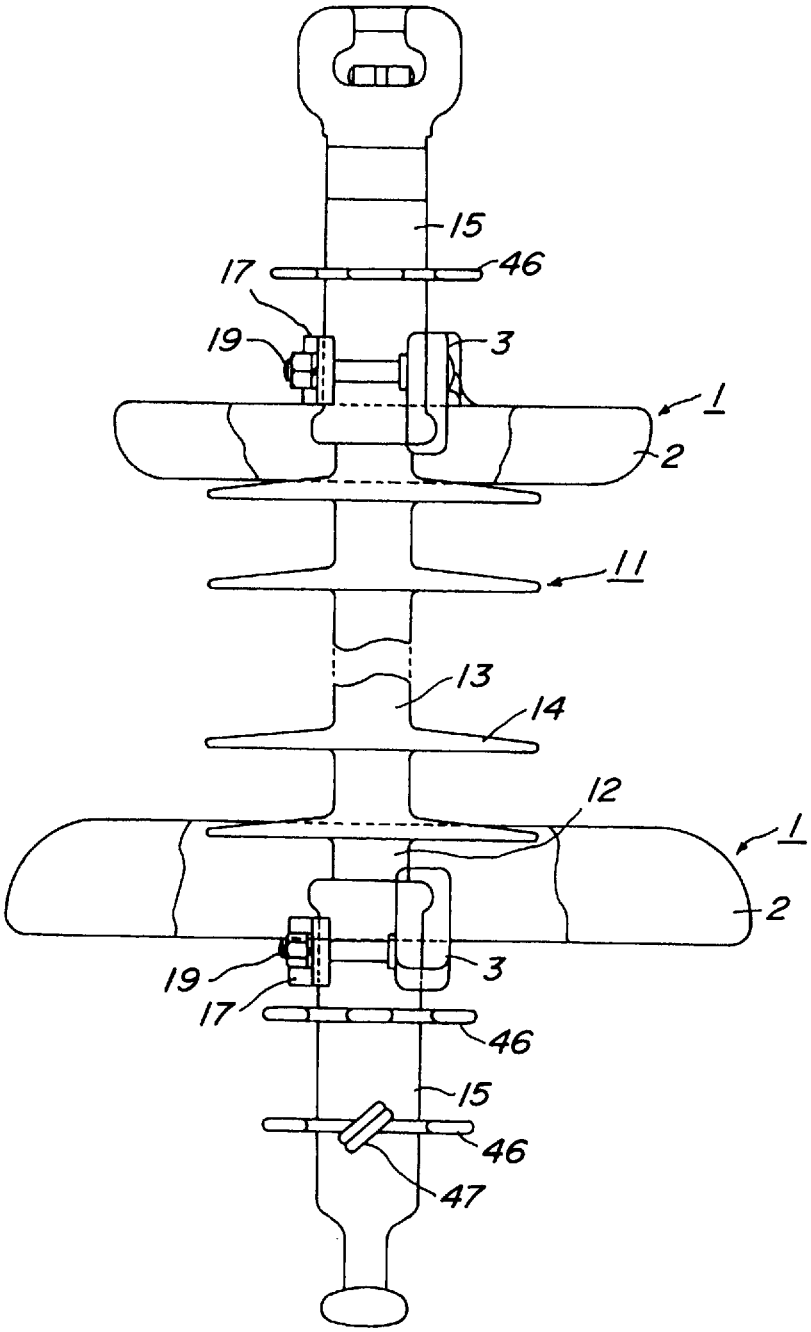
FIG. 5 is a schematic view illustrating one embodiment of a method of securing a corona ring according to a fourth aspect of the invention.

FIG. 5 is a schematic view showing one embodiment of a method of securing a corona ring according to a fourth aspect of the invention. In the embodiment shown in FIG. 5, portions similar to those of FIG. 1 are denoted by the same reference numerals shown in FIG. 1, and explanations thereof are omitted here. In the embodiment shown in FIG. 5, a feature is that a ring metal member 46 is arranged at a predetermined position of the support metal member 15 as the mis-securing prevention member.

In this embodiment, the ring metal member 46 is secured to the support metal member 15 at such a position that the ring metal member 46 does not interfere with the ring securing portion 3 and the metal fitting member 17 if the corona ring 1 is secured in a correct position and that the ring metal member 46 does interfere with the ring securing portion 3 and the metal fitting member 17 if the corona ring 1 is secured in an incorrect position. Therefore, as is the same as the embodiments mentioned above, when the corona ring 1 is fixed to the support metal member 15, the ring securing portion 3 of the corona ring 1 is not secured to the metal fitting member 17 if the corona ring 1 is to be secured in an incorrect position i.e. the corona ring 1 is to be secured to a portion other than the support metal member 15. In the same manner, the ring securing portion 3 of the corona ring 1 is not secured to the metal fitting member 17 if the corona ring 1 is to be secured up side down.

Figure 6A:
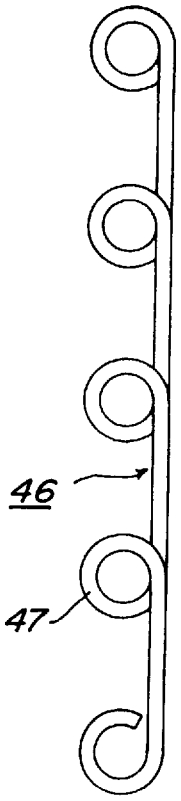
FIGS. 6*a* and 6*b* hare schematic views respectively depicting one embodiment of a ring metal member used in the fourth aspect of the invention.
Figure 6B:
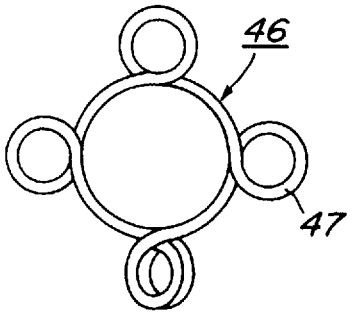
Figure 7:
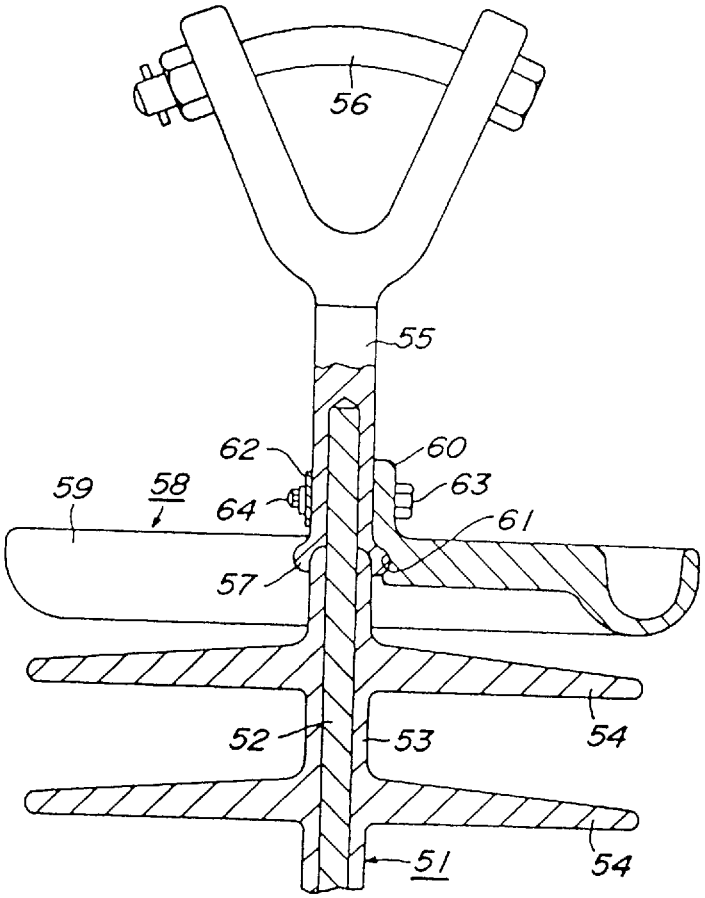
FIG 7 PRIOR ART
FIG. 7 is a schematic view with a partial cross section showing a condition such that the corona ring is secured to a polymer insulator.

In this case, the mis-securing prevention member is not limited to the ring metal member 46 mentioned above, but it is preferred to use the metal member 46 having a construction shown in FIGS. 6*a* and 6*b* since it is easy to secure the ring metal member 46 to the support metal member 15. In this embodiment, as shown in FIG. 6*a*, the ring metal member 46 having a straight shape is preliminarily prepared by forming five mini rings 47 in a stainless line or a copper alloy line by means of a forming work and so on. Then, when the ring metal member 46 is secured to the support metal member 15, the ring metal member 46 is wound around the support metal member 15 and both ends mini rings 47 are twisted with each other. In the embodiment shown in FIG. 5, since a length of the lower support metal member 15 is large, two ring metal members 46 are arranged.

As mentioned above, according to the invention, since the corona discharge preventing means is arranged on the first ring securing portion in the first aspect, since one of the ring securing portions is preliminarily secured to the support member in the second aspect, since a ring securing method at the seal portion of the support member is improved in the third aspect, and since the corona discharge preventing means is arranged on said support member in the fourth aspect, it is not possible to fix the corona ring to the support member if the corona ring is to be secured to an incorrect position with respect to the support member. Therefore, it is possible to prevent a corona ring mis-securing operation.

What is claimed is:

1. A method of securing a corona ring for controlling a corona discharge, comprising the steps of: inserting between a first ring securing portion arranged integrally with said corona ring and a second ring securing portion arranged independently with respect to said first ring securing portion a support member of an insulator; fixing said first ring securing portion and said second ring securing portion to each other; and providing on said first ring securing portion means for interfering with a shed portion of said insulator where said corona ring is improperly mounted, said means for interfering extending substantially parallel to a longitudinal axis of said insulator.

2. The method of securing a corona ring according to claim 1, wherein said means for interfering comprises one of a rod member and a planar member extended along a longitudinal axial direction of said support member from said first ring securing portion.

3. A method of securing a corona ring for controlling a corona discharge, comprising the steps of: inserting between a first ring securing portion arranged integrally with said corona ring and a second ring securing portion arranged independently with respect to said first ring securing portion a support member of an insulator; and fixing said first ring securing portion and said second ring securing portion to each other by (i) fixing preliminarily said second ring securing portion to said support member at a predetermined position by means of a fix member, said fix member comprising one of a hose band and a nut and bolt pair, and (ii) fixing said first ring securing portion to said preliminarily fixed second ring securing portion.

4. The method of securing a corona ring according to claim 3, wherein said second ring securing portion is secured to said support member at a position whereby if said corona ring were improperly mounted said corona ring cannot be secured to said support member due to an interference caused by said fix member.

5. A method of securing a corona ring for controlling a corona discharge, comprising the steps of: inserting between a first ring securing portion arranged integrally with said corona ring and a second ring securing portion arranged independently with respect to said first ring securing portion a support member of an insulator, providing at an end portion of said support member a seal portion which has a larger diameter than substantially all other portions of said support member, forming a seal portion receiving portion at one end surface of said first ring securing portion and said second ring securing portion which faces said support member, and fixing said first ring securing portion and said second ring securing portion to each other such that (i) said seal portion of said support member is fitted with said seal portion receiving portion formed on said first ring securing portion and said second ring securing portion, (ii) a part of said first ring securing portion and said second ring securing portion is brought into contact with said support member, and (iii) a length of at least one of said first ring securing portion and said second ring securing portion from said seal portion receiving portion to the other end thereof along a lengthwise direction of said support member is longer than a distance between said seal portion and a shed portion of said insulator.

6. The method of securing a corona ring according to claim 5, further comprising providing a gap between said first ring securing portion and said support member and a gap between said second ring securing portion and said support member.

* * * * *